US008376335B2

(12) United States Patent
Hiser

(10) Patent No.: US 8,376,335 B2
(45) Date of Patent: Feb. 19, 2013

(54) JIG FOR CUTTING A BRICK OR BRICKS

(75) Inventor: George Gary Hiser, Hampshire (GB)

(73) Assignee: Andy Fitzmaurice, Bath (GB)

( * ) Notice: Subject to any disclaimer, the term of this patent is extended or adjusted under 35 U.S.C. 154(b) by 707 days.

(21) Appl. No.: 12/520,489

(22) PCT Filed: Dec. 20, 2007

(86) PCT No.: PCT/GB2007/004922

§ 371 (c)(1),
(2), (4) Date: Sep. 24, 2009

(87) PCT Pub. No.: WO2008/075071

PCT Pub. Date: Jun. 26, 2008

(65) Prior Publication Data

US 2010/0043771 A1 Feb. 25, 2010

(30) Foreign Application Priority Data

Dec. 21, 2006 (GB) ..... 0625521.0

(51) Int. Cl.
*B25B 1/20* (2006.01)

(52) U.S. Cl. ..... 269/43; 125/23.02

(58) Field of Classification Search ..... 29/281.1; 125/23.02, 35; 269/43, 290, 291
See application file for complete search history.

(56) References Cited

U.S. PATENT DOCUMENTS

| | | | | |
|---|---|---|---|---|
| 2,595,322 | A | 5/1952 | Avery | |
| 4,315,494 | A * | 2/1982 | DiPlacido | 125/35 |
| 4,350,066 | A | 9/1982 | Volk | |
| 4,378,716 | A | 4/1983 | Volk | |
| 4,924,843 | A * | 5/1990 | Waren | 125/35 |
| 5,127,391 | A * | 7/1992 | O'Keefe | 125/13.01 |
| 5,169,045 | A * | 12/1992 | Liu | 225/96.5 |
| 5,662,094 | A * | 9/1997 | Giacomelli | 125/23.01 |
| 6,047,871 | A * | 4/2000 | Chen | 225/96.5 |
| 7,011,085 | B1 * | 3/2006 | Lochotzki | 125/23.02 |

* cited by examiner

*Primary Examiner* — Lee D Wilson
*Assistant Examiner* — Jamal Daniel
(74) *Attorney, Agent, or Firm* — Schwabe, Williamson & Wyatt

(57) ABSTRACT

A jig (1) for cutting a brick or bricks, comprises a base (3) and alignment means (7, 9, 11, 13) arranged such that the brick or bricks can be laid out on the base (3) with part of the or each brick in contact with the alignment means (7, 9, 11, 13). The jig (1) further comprises guide means (35) operative to define a line to be cut along the brick or bricks, the brick or bricks being at least partially restrained and aligned by the alignment means (7, 9, 11, 13) in use such that a cutter can be guided by the guide means (35) to cut the brick or bricks along the defined line to be cut. The guide means (35) comprises an elongate guide element (43) mounted on a chassis, the chassis being adjustably mounted on the jig (1), the chassis comprising a plurality of spaced apart slots, the chassis being adjustably mounted on at least one finger (37) upstanding from the base (3) to enable the position of the chassis relative to the base (3) to be adjusted.

19 Claims, 4 Drawing Sheets

JIG FOR CUTTING A BRICK OR BRICKS

CROSS REFERENCE TO RELATED APPLICATIONS

The present application is a national phase entry of, and claims priority under 35U.S.C. §120 to, International Patent Application No. PCT/GB2007/004922, filed 20 Dec. 2007, entitled "A Jig for Cutting A Brick or Bricks," which designates the United States of America and which claims priority to British Patent Application No. 0625521.0, filed 21 Dec. 2006, entitled "A Jig for Cutting A Brick or Brick," the entire content and disclosure of which is hereby incorporated by reference in its entirety.

The present invention relates to a jig for cutting a brick or bricks.

When constructing buildings it is often necessary to use bricks that are smaller, or of a different shape, to the standard size and shape brick. This is usually achieved by cutting a standard brick using a circular saw, the brick being restrained in use by the bricklayer's foot. Alternatively a hammer and bolster may be used. There is therefore a significant risk of the bricklayer injuring himself with the saw. Additionally, each brick has to be measured and cut individually which is time consuming in terms of constructing an entire building. It can also be problematic to make accurate cuts.

By 'brick' we mean any block used when constructing buildings, walls, patios, roofs or the like including, for example, traditional house bricks, concrete blocks, breeze blocks, roof tiles and paving/patio slabs.

According to a first aspect of the invention there is provided a jig for cutting a brick or bricks, the jig comprising a base and alignment means arranged such that the brick or bricks can be laid out on the base with part of the or each brick in contact with the alignment means, the jig further comprising guide means operative to define a line to be cut along the brick or bricks, the brick or bricks being at least partially restrained and aligned by the alignment means in use such that a cutter can be guided by the guide means to cut the brick or bricks along the defined line to be cut, the guide means comprising an elongate guide element mounted on a chassis, the chassis being adjustably mounted on the jig, the chassis comprising a plurality of spaced apart slots, the chassis being adjustably mounted on at least one finger upstanding from the base, adjustment of the position of the chassis relative to the base being possible by adjusting the particular slot that receives the finger.

Preferably the alignment means comprises a rear alignment means mounted at a rear margin of the base.

Preferably the rear alignment means comprises an elongate alignment surface arranged to be in contact with the brick or bricks in use.

Preferably the alignment surface is planar.

Preferably the rear alignment means is fixed relative to the base.

Preferably a front alignment means is provided at a position on the base opposed to, and spaced apart from, the rear alignment means such that the brick or bricks are restrained in use between the two alignment means.

Preferably the front alignment means is adjustably mounted at the front margin of the base such that the distance between the front and rear alignment means can be adjusted for different sizes of brick.

The front alignment means may be adjustably mounted such that the angle between the longitudinal axes of the front and rear alignment means can be adjusted.

Preferably at least one side alignment means is provided to restrain the brick or bricks in a direction not aligned with the longitudinal axis of the rear alignment means.

Preferably at least one side alignment means is adjustably mounted on the base to enable the angle between the side alignment means and the rear alignment means to be adjusted in use to restrain the brick or bricks such that a cut can be made through the or each brick at an angle inclined from the longitudinal axis of the rear alignment means.

Preferably the angle of the at least one side alignment means is adjustable from a position wherein the longitudinal axis of the side alignment means is substantially perpendicular to the longitudinal axis of the rear alignment means.

Preferably each alignment means comprises a respective bar. Most preferably the or each bar is of quadrilateral transverse cross section.

Preferably the elongate guide element of the guide means has a longitudinal axis that is substantially parallel to that of the rear alignment means.

Preferably the guide means is removably mounted on the jig.

Preferably the guide means is adjustably mounted on the jig such that the distance between the longitudinal axis of the guide means and the longitudinal axis of the rear alignment means can be adjusted to adjust the position of the line to be cut on the brick or bricks.

Preferably measurement means are provided to enable the distance between the rear alignment means and the guide means to be measured to determine the size of cut.

The elongate guide element may itself be adjustably mounted on the chassis.

Preferably the elongate guide element is slidably mounted on the chassis.

Other aspects of the present invention may include any combination of the features or limitations referred to herein.

The present invention may be carried into practice in various ways, but embodiments will now be described by way of example only with reference to the accompanying drawings in which.

Figure 1:
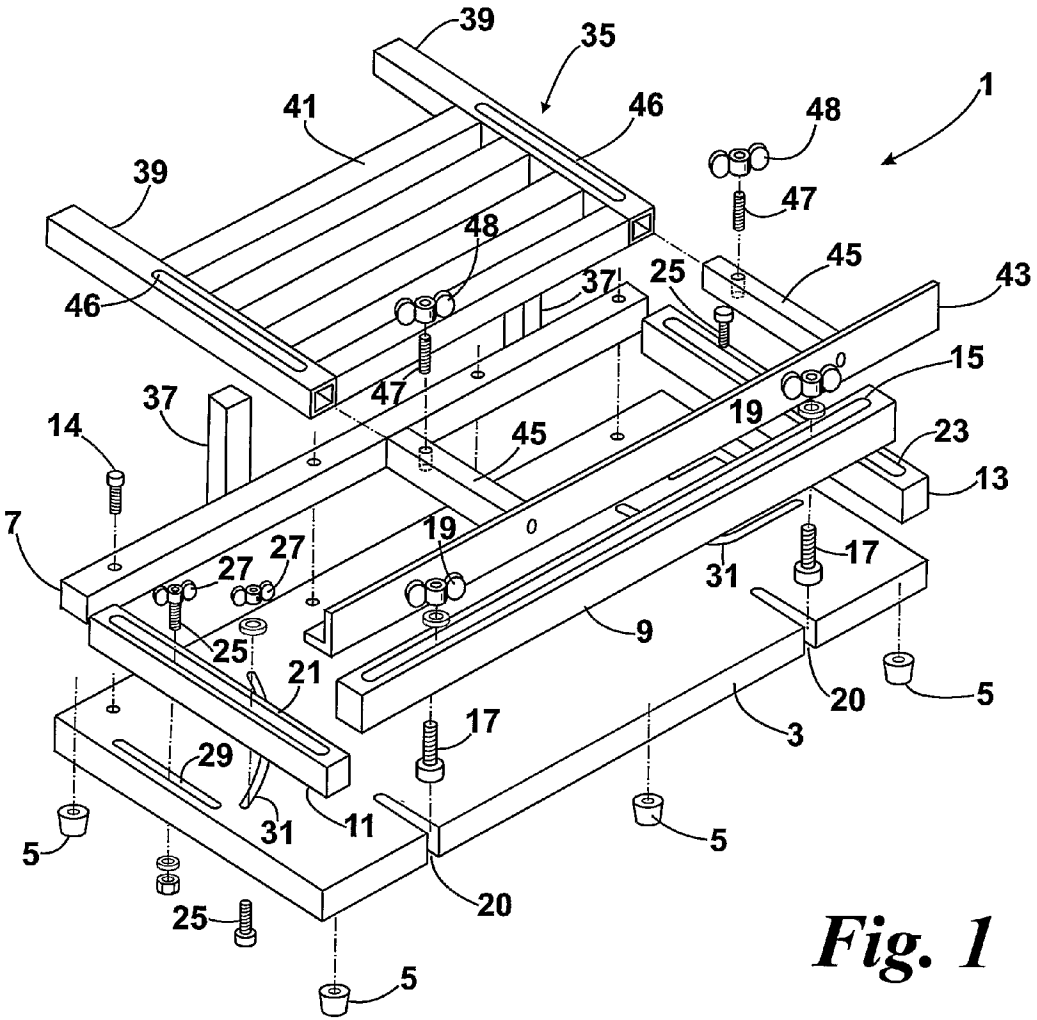
FIG. 1 is a perspective exploded view of a device in accordance with the present invention.
Figure 2:
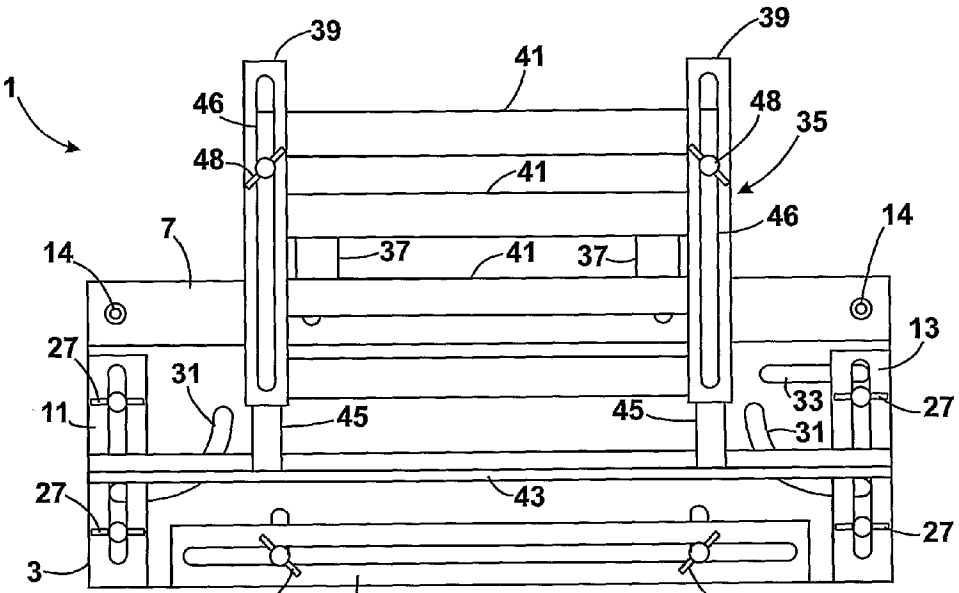
FIG. 2 is a plan view of the device of FIG. 1 in an assembled condition.
Figure 3:
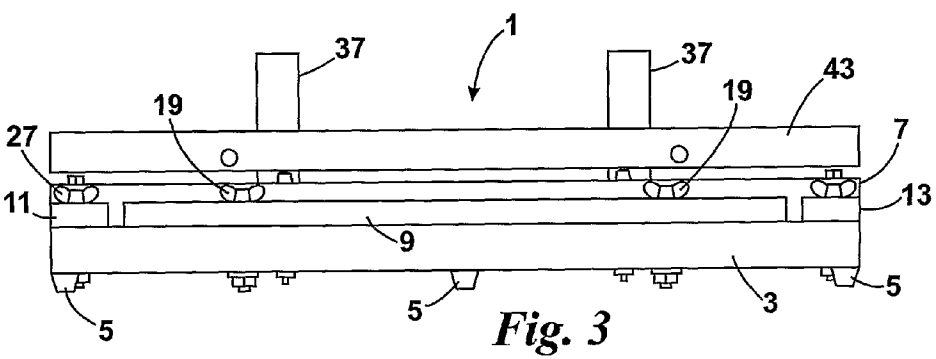
FIG. 3 is a front view of the device of FIGS. 1 and 2.
Figure 4:
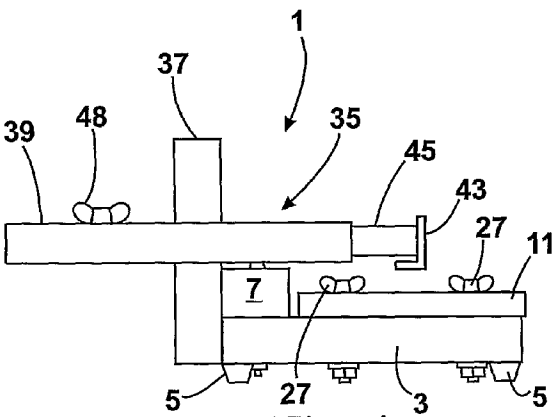
FIG. 4 is an end view of the device of FIGS. 1 to 3.

Referring initially to FIGS. 1 to 4, a jig 1 comprises an oblong planar base 3 that is optionally provided with six rubber feet 5.

Alignment means comprising four elongate, square cross section, hollow bars 7, 9, 11, 13 are releasably mounted on the top surface of the base 3 so as to form a peripheral wall.

The rear bar 7 is mounted along the rear margin of the base 3 and is secured thereto by bolts 14 so that the position of the bar 7 relative to the base 1 is not adjustable in use, although the rear bar 7 can be removed for cleaning if necessary.

The front bar 9 is formed with a through slot 15 extending along the longitudinal axis thereof. In use the bar 9 is secured to the base 3 using bolts 17 and wing nuts 19, the bolts 17 extending through a pair of spaced apart cut-outs 20 formed at the front margin of the base 3 and through the slot 15, the wing nuts 19 releasably clamping the bar 9 to the base 3. The position of the front bar 9 can be adjusted longitudinally by sliding the slot 15 along the bolts 17, and adjusted transversely, that is towards and away from the rear bar 7, by sliding the bolts 17 within the cut-outs 20.

Each side bar 11, 13 is formed with a respective longitudinal through slit 21, 23. Each side bar 11, 13 is releasably secured to the base 3 using a respective pair of bolts 25 and wing nuts 27. The first bolt 25 of each pair extends through a respective elongate side aperture 29 formed adjacent, and parallel to, a respective side margin of the base 3. The second bolt 25 of each pair extends through a respective arcuate aperture 31 formed in the base 3 at a position spaced from the respective side margin of the base.

The combination of the elongate side aperture 29 and the arcuate aperture 31 enables the angle of the longitudinal axis of each side bar 11, 13 to be adjusted relative to the longitudinal axis of the rear bar 7.

The elongate side aperture 29 at one side margin of the base 3 terminates in a perpendicular aperture portion 33 that extends away from that side margin of the base 3. This enables the side bar 13 to be moved towards, whilst remaining parallel to, the other side bar 11.

Guide means 35 is removably mounted on two spaced apart, upwardly directed fingers 37 that are themselves mounted to the rear of the rear alignment bar 7, or to the rear of the base 3 itself.

The guide means 35 comprises a chassis comprising two spaced apart transverse, hollow, square section beams 39 that are joined together by a plurality of square section longitudinal struts 41. Each strut 41 is spaced apart from the adjacent strut 41 by a distance slightly greater than the width of the upwardly directed fingers 37 so as to define a plurality of spaced apart slots such that the fingers 37 can be received in the slots between adjacent struts 41.

The guide means 35 further comprises an elongate guide element in the form of a plate 43 of 'L' shaped transverse cross section, the rear of the guide plate 43 being secured to a pair of spaced apart mounting rods 45 that are slidingly received in use in the beams 39 of the chassis. The top of each beam 39 is formed with an elongate aperture 46 into which a respective threaded stud 47 is received, the stud 47 extending into a respective threaded bore formed in the top of each mounting rod 45. By removing the studs 47 from the respective threaded bores, the rods 45 can be slid into and out of the beams 39 so as to adjust the distance between the longitudinal axis of the guide plate 43 and that of the rear bar 7. When the rods 45 are received in the beams 39, the studs 47 are threaded into the bores. Wing nuts 48 are provided to screw onto the studs 47 to clamp the guide plate 43 in the desired position on the chassis.

In use of the jig 1, a brick or bricks to be cut are arranged in a row on the base 3 with the ends of the bricks abutting the rear bar 7. The longitudinal axis of the bricks are thus perpendicular to the longitudinal axis of the rear bar 7. The rear bar 7 restrains and aligns the bricks by resisting movement of the bricks both in a direction perpendicular to the longitudinal axis of the rear bar 7, and also by resisting rotational movement away from the rear bar 7.

The front bar 9 is then slid towards the rear bar 7 so as to abut the other end of the or each brick.

If a straight cut is to be made across each brick, ie in a direction perpendicular to the longitudinal axis of the brick, then the side bars 11, 13 can be removed. Alternatively one or both side bars 11, depending on how many bricks are to be cut, can be clamped in a position perpendicular to the rear bar 7 to resist movement of the bricks in a direction parallel to the rear bar 7.

In use, a tape measure is used to measure the desired size of cut from the forward margin of the rear bar 7 towards the front bar 9. The chassis of the guide means 35 is then placed over the upstanding fingers 37 so that the fingers 37 are received between a pair of the struts 41 so as to enable the slidable guide plate 43 to be slid to a position wherein the plane of the forwardmost surface of the guide plate 43 is aligned with the desired size of cut as shown on the tape measure. A measurement is made with the tape measure adjacent each finger 37 to ensure that the guide plate 43 is parallel to the rear bar 7. The guide plate 43 is then clamped in position on the chassis using the studs 47 and wing nuts 48 with the underside of the guide plate 43 resting on top of the bricks.

The bricklayer can then use a cutter such as a circular saw or the like to cut the bricks, using the guide plate 43 as a guide against which the side of the circular saw abuts, the guide plate 43 thus guiding the saw in a straight line as it is moved across the brick or bricks to be cut.

It will be appreciated that the bricklayer has only to make two measurements with a tape measure in order to cut a plurality of bricks rather than marking a cut line on each brick. Also he can cut a plurality of bricks in a single operation rather than having to cut each brick separately. Additionally, the bricks are retained and aligned in position using the various bars 7, 9, 11, 13 and so he does not have to hold the bricks in place himself resulting in a safer cutting operation. The bricks being restrained also reduces the likelihood of the bricks moving in use and so improves the accuracy of the cut made for each brick.

If a cut is to be made that is inclined relative to the longitudinal axis of the brick, this angle can be achieved by rotating one or both side bars 11, 13 using the arcuate slots 31. When the side bars 11, 13 are positioned in the desired cutting angle, the bars 11, 13 are clamped in position using bolts 25 and using nuts 27 so as to restrain the brick or bricks at the desired angle as the angled cut is made. In use a cut is made through the brick in a direction parallel to the guide plate 43 and towards one or the other of the side bars 11, 13 in order that movement of the bricks is restricted.

If only one or two bricks are to be cut, the chassis can tilt as only one side of the chassis is resting on the top of the brick(s). To counter this, a dummy brick or the like can be placed under the other side of the chassis so that the chassis remains horizontal.

Figure 5:
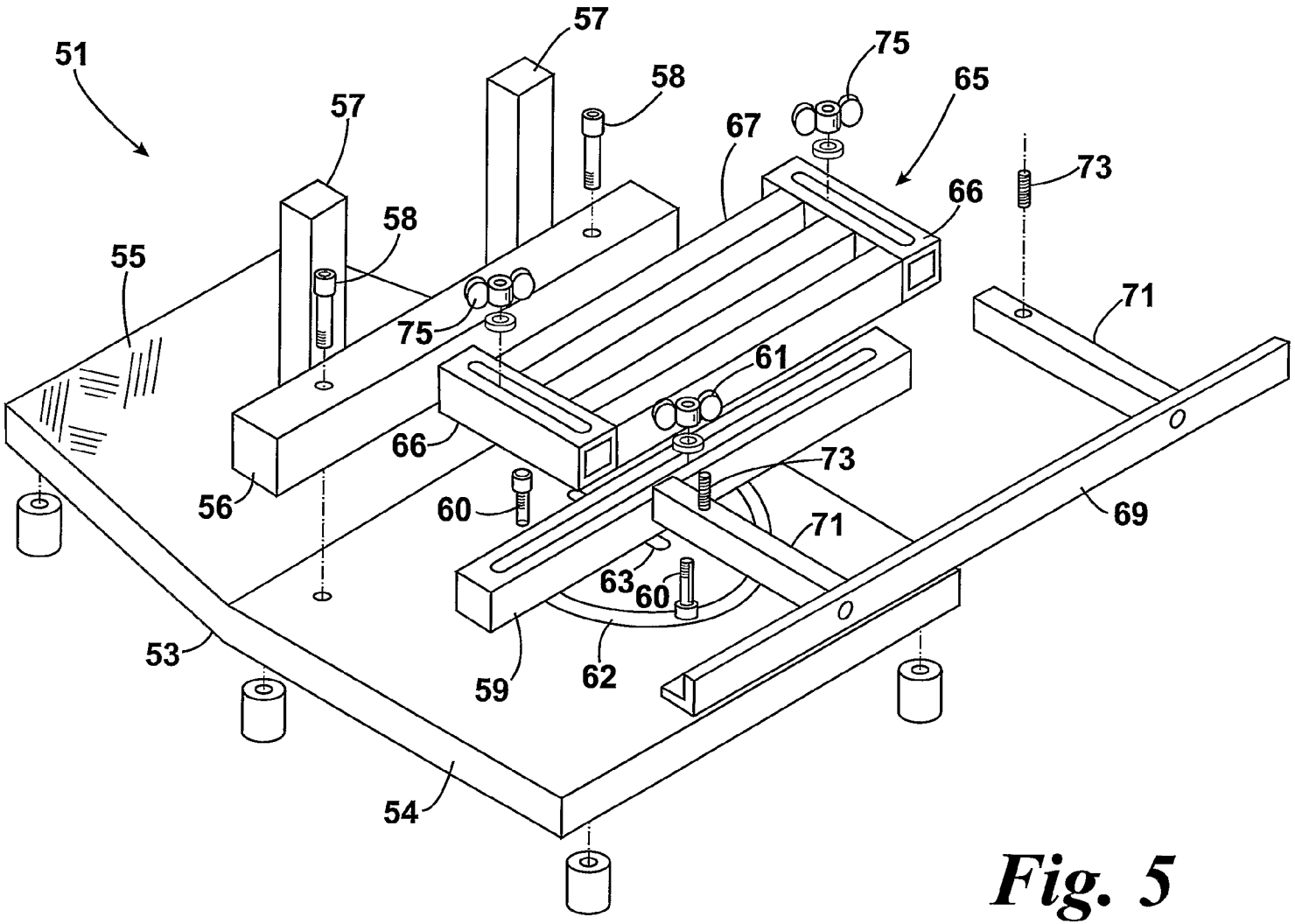
FIG. 5 is a perspective exploded view of another device in accordance with the present invention.
Figure 6:
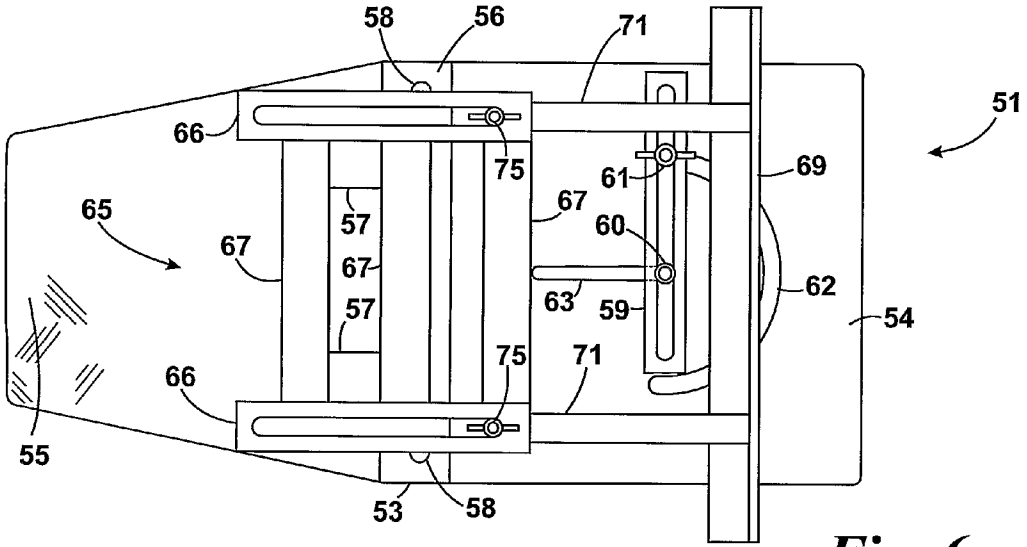
FIG. 6 is a plan view of the device of FIG. 5 in an assembled condition.
Figure 8:
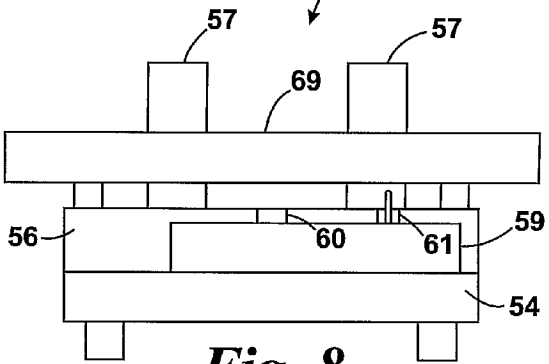
FIG. 8 is a front view of the device of FIGS. 5 to 7.
Figure 7:
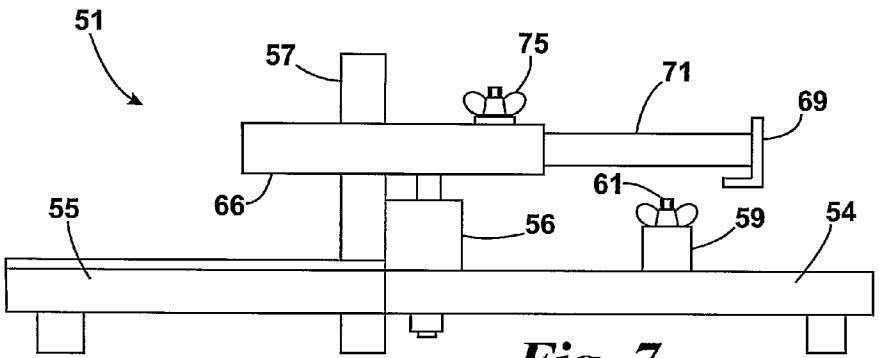
FIG. 7 is an end view of the device of FIGS. 5 and 6.

Referring to FIGS. 5 to 8, another jig 51 is a smaller version of the jig 1 described above with generally similar features.

In this embodiment the base 53 comprises an oblong forward portion 54 and a tapered rear portion 55. The rear portion 55 comprises a textured surface on which the bricklayer's foot or knee rests in use to resist the jig 51 moving as the brick cut is made.

A rear alignment bar 56 is mounted at the rear margin of the oblong base portion 54 using bolts 58, with fingers 57 upstanding from the rear of the bar 56.

A front alignment bar 59 is removably and adjustably mounted on the oblong base portion 54 via bolts 60 extending through slots in the base 53 so that the front alignment bar 59 can be moved towards and away from the rear bar 56 whilst remaining parallel to the rear bar 56, and also so that the front bar 59 can be rotated in the plane of the base 53 relative to the rear bar 56 so that angled cuts can be made. This is achieved by the provision on the oblong base position 54 of a first semi circular slot 62 and a straight slot 63 that is perpendicular to the longitudinal axis of the rear bar 56. The front bar 59 can be clamped in position using wing nut 61 that screws onto the bolt 60 that extends through the straight slot 63.

In this embodiment the chassis 65 only has three struts 67 between two beams 66 and can be clamped in position using studs 73 and wing nuts 75.

The guide plate 69 is again mounted on rods 71 that are slidably received in the beams 66 and can be clamped in position using studs 73 and wing nuts 75.

The jig 51 is used for cutting individual or small numbers of bricks.

It is envisaged that the base, alignment means and guide means of each jig 1, 51 would be made from a metal material such as aluminium although any other suitable material could alternately be used.

It is also envisaged that the alignment means and guide means could be mounted on, and secured to the base using any suitable means which could include quick release clamps or snap fit connections instead of, or in addition to, the bolts and wing nuts.

The base may be provided with a replaceable upper surface that can be removed and replaced if damaged during the cutting process.

Each jig 1, 51 may be provided with feet to space each jig 1, 51 above the ground.

The side bars 11, 13 may be provided with laterally extending spacers, such as a plate portion for example, to space, in use, the bricks nearest the side bars 11, 13 from the longitudinal axes of the side bars 11, 13.

The invention claimed is:

1. A jig for cutting a brick or bricks, the jig comprising a base and alignment means arranged such that the brick or bricks can be laid out on the base with part of the or each brick in contact with the alignment means, the jig further comprising guide means operative to define a line to be cut along the brick or bricks, the brick or bricks being at least partially restrained and aligned by the alignment means in use such that a cutter can be guided by the guide means to cut the brick or bricks along the defined line to be cut, the guide means comprising an elongate guide element mounted on a chassis, the chassis being adjustably mounted on the jig, the chassis comprising a plurality of spaced apart slots, the chassis being adjustably mounted on at least one finger upstanding from the base, adjustment of the position of the chassis relative to the base being possible by adjusting the particular slot that receives the finger.

2. The jig of claim 1 wherein the alignment means comprises a rear alignment means mounted at a rear margin of the base.

3. The jig of claim 2 wherein the rear alignment means comprises an elongate alignment surface arranged to be in contact with the brick or bricks in use.

4. The jig of claim 3 wherein the alignment surface is planar.

5. The jig of claim 2 wherein the rear alignment means is fixed relative to the base.

6. The jig of claim 2 wherein a front alignment means is provided at a position on the base opposed to, and spaced apart from, the rear alignment means such that the brick or bricks are restrained in use between the two alignment means.

7. The jig of claim 6 wherein the front alignment means is adjustably mounted at the front margin of the base such that the distance between the front and rear alignment means can be adjusted for different sizes of brick.

8. The jig of claim 7 wherein the front alignment means is adjustably mounted such that the angle between the longitudinal axes of the front and rear alignment means can be adjusted.

9. The jig of claim 2 wherein at least one side alignment means is provided to restrain the brick or bricks in a direction not aligned with the longitudinal axis of the rear alignment means.

10. The jig of claim 9 wherein at least one side alignment means is adjustably mounted on the base to enable the angle between the side alignment means and the rear alignment means to be adjusted in use to restrain the brick or bricks such that a cut can be made through the or each brick at an angle inclined from the longitudinal axis of the rear alignment means.

11. The jig of claim 10 wherein the angle of the at least one side alignment means is adjustable from a position wherein the longitudinal axis of the side alignment means is substantially perpendicular to the longitudinal axis of the rear alignment means.

12. The jig of claim 1 wherein each alignment means comprises a respective bar.

13. The jig of claim 12 wherein the or each bar is of quadrilateral transverse cross section.

14. The jig of claim 1 wherein elongate guide element of the guide means has a longitudinal axis that is substantially parallel to that of the rear alignment means.

15. The jig of claim 1 wherein the guide means is removably mounted on the jig.

16. The jig of claim 14 wherein the guide means is adjustably mounted on the jig such that the distance between the longitudinal axis of the guide means and the longitudinal axis of the rear alignment means can be adjusted to adjust the position of the line to be cut on the brick or bricks.

17. The jig of claim 16 wherein measurement means are provided to enable the distance between the rear alignment means and the guide means to be measured to determine the size of cut.

18. The jig of claim 1 wherein the elongate guide element is itself adjustably mounted on the chassis.

19. The jig of claim 18 wherein the elongate guide element is slidably mounted on the chassis.

* * * * *